US005857135A

United States Patent [19]

Hayashida et al.

[11] Patent Number: 5,857,135

[45] Date of Patent: Jan. 5, 1999

[54] IMAGE FORMING APPARATUS EQUIPPED WITH PRE-TRANSFER DRUM CHARGER

[75] Inventors: Masatoshi Hayashida, Kanagawa-ken; Yuichi Yokoyama, Tokyo, both of Japan

[73] Assignee: Kabushiki Kaisha Toshiba, Kawasaki, Japan

[21] Appl. No.: 889,585

[22] Filed: Jul. 8, 1997

[30] Foreign Application Priority Data

Aug. 23, 1996 [JP] Japan ..... 8-222801

[51] Int. Cl.[6] ..... G03G 15/14

[52] U.S. Cl. ..... 399/296; 399/66

[58] Field of Search ..... 399/296, 66, 314, 399/364, 388; 430/126

[56] References Cited

U.S. PATENT DOCUMENTS

| | | | |
|---|---|---|---|
| 4,482,240 | 11/1984 | Kuge et al. | 399/296 |
| 4,825,250 | 4/1989 | Miyata et al. | 399/364 X |
| 4,937,630 | 6/1990 | Yoshikawa et al. | 399/296 X |
| 5,155,541 | 10/1992 | Loce et al. | 399/296 X |
| 5,333,037 | 7/1994 | Inoue et al. | 399/66 X |

FOREIGN PATENT DOCUMENTS

| | | |
|---|---|---|
| 3-102382 | 4/1991 | Japan . |
| 6-258962 | 9/1994 | Japan . |
| 7-31459 | 4/1995 | Japan . |

*Primary Examiner*—Arthur T. Grimley
*Assistant Examiner*—Sophia S. Chen
*Attorney, Agent, or Firm*—Foley & Lardner

[57] ABSTRACT

An image forming apparatus includes a developing device for developing an electrostatic latent image formed in a prescribed region on an image carrier corresponding to an original document with a charged developer to form a developer image on the image carrier, a transfer charger for transferring the developer image onto an image receiving medium from the image carrier, and a pre-transfer charger for applying an electric charge having the same polarity as that of the charged developer to the image carrier before transferring the developer image onto the image receiving medium. The apparatus further includes a controller for controlling the pre-transfer charger so that the electric charge is applied only to a given area extending from a front end of the prescribed region on the image carrier on which the developer image is formed, the given area smaller than the prescribed region.

13 Claims, 5 Drawing Sheets

IMAGE FORMING APPARATUS EQUIPPED WITH PRE-TRANSFER DRUM CHARGER

BACKGROUND OF THE INVENTION

1. Field of the Invention

The present invention relates to an image forming apparatus which forms a toner image on a photoconductive drum according to a photoelectrostatic process and more particularly to an image forming apparatus equipped with a pre-transfer drum charger which charges a photoconductive drum before transferring a toner image on a paper.

2. Description of the Related Art

An image forming apparatus using a photoelectrostatic process, for instance, an electrostatic copying machine contains an image reading portion to read an image to be copied and an image forming portion to form an image to be copied based on an image read by way of this image reading portion and output the formed image on a transfer material. This image forming portion has a paper conveying path to take a transfer material, that is, paper out of a paper stacker one by one and convey a paper having a transferred and fixed image to an exit port.

In recent years, an electrostatic copying machine equipped with a pre-transfer drum charger which charges a photoconductive drum before transferring a toner image formed on the photoconductive drum through the electrostatic process has been put for practical use in its image forming portion as described above. This pre-transfer drum charger is arranged around a photoconductive drum and between a developing device and a transferring device.

This pre-transfer drum charger charges an toner image formed on a photoconductive drum using AC voltage, DC voltage having the same polarity as that of a toner or AC voltage with DC voltage superposed.

Thus, as a result of the charging of a toner image by the pre-transfer drum charger, it becomes possible to discharge the surface of the photoconductive drum after the development and at the same time, enhance the electric charge retained by the toner image and efficiently transfer the toner image in the next transfer process and the separation process. Further, it also becomes possible to prevent occurrences of so-called re-transfer phenomenon wherein a toner to be transferred on a paper is returned to the photoconductive drum, image void, etc.

However, such a conventional pre-transfer drum charger has such problems as described below.

That is, as shown in FIG. 1, a developing device 33 has normally a small amount of a reverse charged toner B which has the polarity reverse to a normal toner A besides this normal toner A which has the positive polarity and is adsorbed to an image portion of a photoconductive drum 30 around a developing roller 33*a*.

The potential of the white ground portion, that is, the non-image forming portion of the photoconductive drum 30 is at, for instance, −30 through −150 V. On the other hand, the developing roller 33*a* of the developing device 33 is set at a higher potential than that of the white ground portion of the photoconductive drum, for instance, at −200V.

So, static electricity is added to the normal toner A charged with positive electric charge in the arrow direction shown in FIG. 1 and the toner A is attracted to the developing roller 33*a* having the higher negative potential. Thus, the white ground portion of the photoconductive drum 30 is not developed.

On the other hand, static electricity is added to the reverse charged toner B charged with negative electric charge in the arrow direction in FIG. 1 and the toner is attracted to the photoconductive drum 30 side which has the lower negative potential. Thus, the toner is adhered to the white ground portion of the photoconductive drum 30.

On a conventional pre-transfer drum charger, there are such problems that electric charge of the same polarity as the normal toner is uniformly given to the reverse charged toner B adhered on the non-image portion of the photoconductive drum in addition to the normal toner A adhered on the image portion of the photoconductive drum. As a result, the reverse charged toner B is also transferred on a paper in the next transferring process and the so-called fog is produced, deteriorating the quality of an image formed on a paper.

Further, in a developer comprising two ingredients having toner to develop an electrostatic latent image on a photoconductive drum and a carrier to feed these toners to a developing region, if the toner content increased from the 5 to 6% proper toner mixed ratio, that is, a toner concentration increased, a reverse charged toner content also increases. As a result, the fog level on a paper increases and the quality of image will be extremely deteriorated.

SUMMARY OF THE INVENTION

An object of the present invention is to provide an image forming apparatus which is capable of providing an image of good quality.

According to the present invention, it is provided an image forming apparatus comprising means for developing an electrostatic latent image formed in a prescribed region on an image carrier corresponding to an original document with a charged developer to form a developer image on the image carrier; means for transferring the developer image onto an image receiving medium from the image carrier; means for applying an electric charge having the same polarity as that of the charged developer to the image carrier before transferring the developer image onto the image receiving medium; and means for controlling the applying means so that the electric charge is applied only to a given area extending from a front end of the prescribed region on the image carrier on which the developer image is formed, the given area smaller than the prescribed region.

DETAILED DESCRIPTION OF THE PREFERRED EMBODIMENT

Hereinafter, one embodiment of an image forming apparatus of the present invention will be described in detail with reference to the attached drawings.

Figure 2:
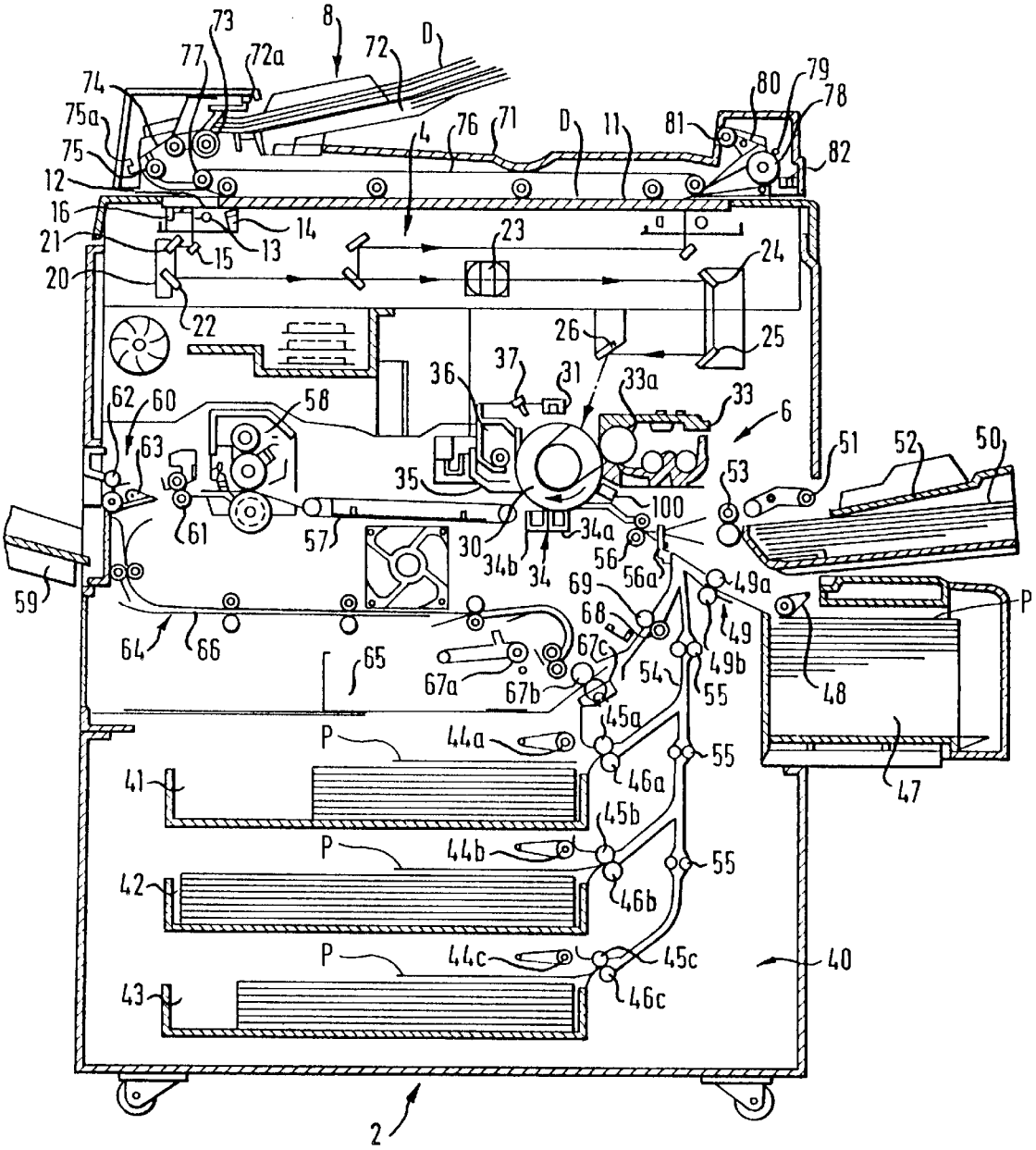
FIG. 2 is a sectional view schematically illustrating one example of an electrophotographic analog copying machine involved in an image forming apparatus of the present invention.

FIG. 2 is a sectional view schematically illustrating the image forming apparatus of the present invention.

As shown in FIG. 2, the image forming apparatus, that is, an electrophotographic analog copying machine 2 has an image reading portion 4 which functions as a reading means and an image forming portion 6 which functions as an image forming means. Further, on the top of the image reading portion 4, there is set an automatic document feeder (hereinafter referred to as ADF) 8 which is formed to be able to open/close against a document table of the image reading portion, which is described later and feeds a subject to be read, that is, an original document D to the document table one by one and functions as a document retainer to closely fit a document placed on the document table.

The image reading portion 4 is faced to the ADF 8 that is in the closed state on its top, and has a document table 11 comprising a transparent glass on which the original document D is set and an original scale 12 which is arranged at one end of the document table 11 to indicate a reference position when setting the original document D on the document table 11. Further, there is arranged an operation panel (not shown) near the document table 11.

Under the document panel 11, as component elements of the image reading portion 4 there are arranged an exposure lamp 13 to illuminate the original document D placed on the document table 11, a reflector 14 for focusing the light from the exposure lamp 13 to the original document D and a first mirror 15 to fold the reflecting light from the original document D in the left direction in the figure. The exposure lamp 13, the reflector 14 and the first mirror 15 are fixed to a first carriage 16 and are movable in parallel with the document table 11 with the movement of the first carriage 16. Further, the first carriage 16 is moved along the document table 11 in parallel with it as the driving force of a pulse motor (not shown) is transmitted thereto via a toothed belt, etc.

In the direction wherein the light reflected by the first mirror 15 is guided at the left side of the document table 11 in the figure, there is arranged a second carriage 20 which is formed movable in parallel with the document table 11 via a driving mechanism, for instance, a toothed belt and a DC motor (not shown).

The second carriage 20 is provided with a second mirror 21 which refracts the reflecting light from the original document D guided by the first mirror 15 downward and a third mirror 22 which reflects the reflecting light to the right direction in the figure at a right angle to each other. The second carriage 20 is moved following the first carriage 16 by a toothed belt (not shown) which drives the first carriage 16 in parallel with the document table 11 at a ½ speed of the first carriage 16.

In the surface below the first carriage 16, including an optical axis of the light returned via the second carriage 20, there are arranged a lens 23 to focus the reflecting light from the second carriage 20 at a prescribed magnification, a fourth mirror 24 to refract the reflecting light which can be focused by the lens 23 downward, a fifth mirror 25 which refracts the reflecting light from the fourth mirror 24 to the left side in the figure and a sixth mirror 26 which guides this reflecting light to the photoconductive drum 30.

The image forming portion 6 has the photoconductive drum 30 which is an image carrier positioned rotatably at almost the center of the copying machine 2. The photoconductive drum 30 is rotated at a prescribed rotational speed by a motor (not shown).

At the prescribed positions around the photoconductive drum 30, there are arranged a main charger 31 which charges the surface of the photoconductive drum 30 to a prescribed electric level and the developing device 33 which has a developing roller 33*a* to develop an electrostatic latent image formed on the surface of the photoconductive drum 30 through the exposure by the reflecting light of the original document D guided from the image reading portion 4 at a desired image concentration by feeding a toner as a developer. This developing device 33 accommodates a two-ingredient developer including a toner having the positive electric charge and a carrier.

Further, around the photoconductive drum 30 and at the downstream of the developing device 33, there is arranged a pre-transfer drum charger 100 which functions as an electric charge applying means to charge a toner image formed by developing an electrostatic latent image on the photoconductive drum 30 with a toner before transferring it on a transfer material, that is, a paper P fed from a paper cassette which will be described later. In addition, a transfer charger 34*a* to transfer a toner image formed on the photoconductive drum 30 on a paper P, a separation charger 34*b* for separating the paper P with the toner image transferred, a separation claw 35 to separate the paper P from the surface of the photoconductive drum 30, a cleaning unit 36 which cleans a toner remained on the surface of the photoconductive drum 30, and a discharge unit 37 which removes the potential remained on the surface of the photoconductive drum 30 are arranged in order.

At the bottom of the copying machine 2 positioned below the photoconductive drum 30, a multi-stage paper feeder or a paper feed pedestal (hereinafter referred to as PFP) 40 is arranged in one united body with the copying machine 2 as a paper feeding means mounted at the upper and lower multiple stages removably from the front side of the copying machine 2.

The PFP 40 is composed of an upper-stage cassette 41, a middle-stage cassette 42 and a lower-stage cassette 43 for accommodating plural kinds of copying paper P in various sizes in about 500 sheets of, for instance, A4, B4 and A3 size copying paper which are placed in respective cassettes so that they are conveyed along the longitudinal direction.

At the prescribed positions of the upper-stage cassette 41, the middle-stage cassette 42 and the lower-stage cassette 43, pickup rollers 44*a*, 44*b* and 44*c* to take out the paper P by one sheet at a time from respective paper cassettes 41, 42 and 43 are arranged.

At the positions where the leading edges of the paper P taken out of the paper cassettes 41, 42 and 43 by the pickup rollers 44*a*, 44*b* and 44*c* pass, there are arranged feeding rollers 45*a*, 45*b* and 45*c* and separation rollers 46*a*, 46*b* and 46*c* which are arranged in one united body with respective feeding rollers for separating the paper P one by one sheet. The separation rollers 46*a*, 46*b* and 46*c* are so arranged that their shaft lines are brought in contact with respective combined feeding rollers in parallel with each other at a prescribed pressure and are rotated in the direction reverse to the rotational direction of the feeding rollers so as to send the top one sheet of the paper P taken out of each cassette to a paper conveying path which is described later.

At the right side to the PFP 40 in the figure, there is provided a large capacity feeder (hereinafter referred to as LCF) 47, which is formed to be able to accommodate about 3000 sheets of paper P in size of high frequency of use, for instance, A4 size paper. At a prescribed position of the LCF 47, there is arranged a pickup roller 48 to take out the paper P accommodated in the LCF 47 by one by one sheet. Between the pickup roller 48 and the photoconductive drum 30, there is arranged a separation unit 49 including one set of an upper feeding roller 49*a* and a lower separation roller 49*b*. The separation unit 49 sends out the top one sheet of the paper P taken out of the LCF 47 by the pickup roller 48 to the paper feeding path by rotating the separation roller 49*b* in the direction reverse to the rotational direction of the feeding roller 49*a*.

On the top of the LCF 47, a manual paper feeder 50 which is capable of feeding a copying paper P is formed independent of the paper cassettes 41, 42, 43 and LCF 47. Between the manual paper feeder 50 and the photoconductive drum 30, there are provided a manual feeding pickup roller 51 to take in the paper P inserted into the manual paper feeder 50, a manual paper guide 52 to guide the paper P taken in by the pickup roller 51 and a feeding roller 53 to convey the paper P which is guided to the photoconductive drum 30 via the manual paper guide 52.

Between the paper cassettes 41, 42 and 43, LCF 47 and the photoconductive drum 30, there is formed a paper conveying path 54 to guide the paper P from the cassettes 41, 42 and 43 and LCF 47 toward the photoconductive drum 30. This conveying path 54 is further extended to the outside of the copying machine 2 through a transferring region defined between the photoconductive drum 30 and the transfer/separation charger 34. Further, plural feeding rollers for conveying the paper P fed from any cassette or the LCF or the manual paper guide to the photoconductive drum 30 are provided for the paper conveying path 54.

Near the photoconductive drum 30 and at the upper stream side of the paper conveying path 54, there is provided an aligning roller 56 which corrects the tilt of copying paper P guided on the paper conveying path 54, aligns the leading edge of a toner image on the photoconductive drum 30 with the leading edge of copying paper P and feeds copying paper P to the transferring region at the same speed as the moving speed of the outer surface of the photoconductive drum 30. In addition, at this side of the aligning roller 56, that is, at a feeding roller 55 side, there is provided an aligning sensor 56*a* which detects the arrival of copying paper P at the aligning roller 56.

In the direction in which the paper P passed through the transferring region advances, a conveyor belt 57 to convey paper P is assembled. At the position in the direction in which paper P is conveyed by the conveyor belt 57 and a heat is hardly given to the photoconductive drum 30, there is provided a fixing unit 58, including a heat roller pair of which surfaces are pressure fit each other, to fix a toner image on a paper P by pressing the toner image and the paper P while dissolving the toner image by heating the paper P carrying the transferred toner image.

On the side wall of the copying machine 2 opposing to the fixing unit 58, there is arranged a receiving tray 59 in which the paper P carrying the toner image fixed by the fixing unit 58 is ejected.

Between the fixing unit 58 and the receiving tray 59, there is arranged a gate unit 60 to guide the copying paper P carrying the toner image fixed by the fixing unit 58 either to a paper inverting portion which will be described later or the receiving tray.

The gate unit 60 is arranged between first and second exit rollers 61 and 62 which push the paper P passed through the fixing unit 58 forward, and has a gate flapper 63 which selectively distributes the copying paper P passed through the fixing unit 58 either to the receiving tray 59 or the paper inverting portion which will be described later.

An automatic duplex unit (hereinafter referred to as ADU) 64, including a paper inverting mechanism, has a temporary stacker 65 to temporarily stack copying paper P already passed through the transferring region and the fixing unit 58, an inverting path 66 to invert the copying paper P passed through the fixing unit 58 and lead to the temporary stacker 65, a paper supply roller 67*a* to take out copying paper P stacked in the temporary stacker one by one sheet, a pair of a feeding roller 67*b* and a separation roller 67*c* arranged for separating paper P one by one sheet, an inverting feed path to guide paper P accommodated in the temporary stacker 65 again to the aligning roller 56, and a paper supply roller 69 to feed the paper P guided to the inverting feed path 68 toward the aligning roller 56.

The ADF 8 has a cover 71 of which rear edge portion is attached to the upper rear edge portion of the copying machine 2 via hinges (not shown) so that it can be opened/closed against the document table 11 of the image reading portion 4 by moving and displacing the entire ADF 8 as necessary.

At the slightly left side on the top of the cover 71, there is provided a document feeding table 72 to hold plural sheets of an original document D. At the left to a document feeding table 72 in the figure, that is at one end side of the ADF 8, there is arranged a document supply roller 73 to take out original documents that are set on the document feeding table 72 one by one sheet successively and feed to the one end side of the document table 11 of the image reading portion 4 from the left end side in the figure. At the prescribed position of the document feeding table 72, there is arranged an empty sensor 72*a* which is a document detecting sensor to detect whether original documents D are set on the document feeding table 72.

In the original document take-out direction of the document supply roller 73, there are arranged a document feeding roller 74 to send out the documents D taken out by the document supply roller 73 toward the document table 11 and an aligning roller 75 to align the leading edges of the documents D fed by the document feeding roller 74. Further, an aligning sensor 75*a* is arranged between the aligning roller 75 and the document feeding roller 74 to detect the arrival of the original document D at the aligning roller 75.

At the position inside the cover 71 opposing to the document table 11 of the image reading portion 4 in the state where the ADF 8 is kept closed, there is arranged a conveyor belt 76 in a size covering the almost entire document table 11 for conveying original documents D conveyed from the document feeding table 72 via the document supply roller 73, the document feeding roller 74 and the aligning roller 75 to a prescribed position of the document table 11. The conveyor belt 76 is put over a pair of belt rollers 77 arranged at the left and right in the figure and is rotated in the both directions of the right and left sides in the figure by a belt driving mechanism (not shown).

At the right side to the ADF 8, there are arranged an inverting roller 78 to send the original document D moved from the left side to the right side in the figure to the outside of the cover 71, a pinch roller 79 to push the original document D against the inverting roller 78, a flapper 80 to change it over to return the original document D conveyed by the inverting roller 78 and the pinch roller 79 to the conveyor belt 76 again or to discharge the document to a prescribed ejecting position, that is, on the cover 71, a discharge roller 81 to discharge the document D conveyed by the inverting roller 78 when the flapper 80 is changed over to the discharge side and a document jamming sensor 82 to detect the jamming of the document near the inverting roller 78.

Further, the copying machine 2 is also provided with a document jamming sensor to detect the jamming of paper P in the paper conveying path 54 to convey paper P supplied from any paper cassette or the LCF or the manual paper guide toward the ADU 64 or the outside of the copying machine via the photoconductive drum 30.

In the copying machine 2 described above, a first image forming process to form an image on one surface of a paper is executed.

That is, the surface of the photoconductive drum 30 is charged uniformly at −500 V by the main charger 31 applied with negative DC bias voltage. Then, the light reflected on the original document D is guided to the surface of the photoconductive drum 30 by the image reading portion 4 and exposed thereon. By this exposure an electrostatic latent image is formed on the surface of the photoconductive drum 30, the bright portion, that is, the potential of the non-image portion is within a range of −150 V through −50 V according to the quantity of light of the exposure lamp 13 and the potential of the image portion is at about −200 V through −450 V.

In succession, the electrostatic latent image on the photoconductive drum 30 is developed and a toner image is formed by a toner which is stored and has the positive electric charge in the developing device 33. The developing roller 33*a* is applied with −200 V DC bias voltage. Accordingly, as the surface potential of the photoconductive drum 30 is lower than that of the developing roller 33*a,* a positive charged toner for the non-image portion is attracted to the developing roller 33*a* side and does not adhere to the photoconductive drum. Further, as the surface potential of the photoconductive drum 30 is higher than that of the developing roller 33*a,* the toner for the image portion adheres to the photoconductive drum 30 and thus, a toner image is formed.

In succession, by a pre-transfer drum charger 100 applied with voltage of the same polarity as that of the toner, that is, for instance, 4–5 kV positive DC bias voltage, the surface of the photoconductive drum 30 is discharged and the toner image formed on the photoconductive drum 30 is positively charged.

In succession, by the transfer charger 34*a* applied with the negative DC bias voltage, the paper P conveyed for the toner image formed on the photoconductive drum is charged to, for instance, −500 V. As a result of this charging, the toner image is attracted to the paper P side and the toner image is transferred on the paper P from the photoconductive drum 30.

In succession, the paper P is separated from the photoconductive drum 30 when the paper P is charged by the separation charger 34*b* applied with, for instance, 1 kHz AC voltage.

The paper P separated from the photoconductive drum 30 is conveyed to the fixing unit 58 and the toner image is fixed on the paper P.

Thus, in the first image forming process, an image is formed on one surface of the paper P. Then, in the single surface mode wherein an image is formed on only one surface of a paper, the paper P with a fixed toner image is discharged on the receiving tray 59 via the gate flapper 63.

In the double surface mode wherein images are formed on both surfaces of the paper P, the paper with fixed toner images is conveyed to the ADU 64 by the gate flapper 63.

In the double surface mode, the paper P processed in the first image forming process is conveyed to the ADU 64 and a second image forming process is executed to form an image on the other surface of the paper P.

That is, the paper conveyed to the ADU 64 is temporarily stacked in the temporary stacker 65 and taken out by the paper supply roller 67 at a prescribed timing. Then, paper P is supplied to the aligning roller 56 by the paper supply roller 69.

On the other hand, in the image forming portion 6, the photoconductive drum 30 is cleaned by the cleaning unit 36 and after discharged by the discharge unit 37, uniformly charged again to −500 V by the main charger 31. Then, the photoconductive drum 30 is exposed by the reflecting light corresponding to an original document D. By this exposure, an electrostatic latent image is formed on the surface of the photoconductive drum 30.

In succession, the electrostatic latent image on the photoconductive drum 30 is developed by a positively charged toner housed in the developing device 33 and a toner image is formed.

In succession, the surface of the photoconductive drum 30 is discharged by the pre-transfer drum charger 100 applied with voltage of the same polarity as that of the toner, that is, positive DC bias voltage and the toner image formed on the photoconductive drum 30 is positively charged.

Then, the paper P conveyed to the toner image formed on the photoconductive drum 30 is charged to, for instance, −500 V by the transfer charger 34*a* which is applied with the negative DC bias voltage. As a result of this charge, the toner image is attracted to the paper P side and the toner image is transferred on the paper P from the photoconductive drum 30.

In succession, the paper P is separated from the photoconductive drum 30 as the paper P is charged by the separation charger 34*b* applied with, for instance, 1 kHz AC voltage.

The paper P separated from the photoconductive drum 30 is conveyed to the fixing unit 58 wherein the toner image is fixed on the paper P.

Thus, in the second image forming process an image is formed on the other surface of the paper P. Then, the paper P carrying images formed on both surfaces of the paper P in the both surface mode is discharged on the receiving tray 59 via the gate flapper 63.

Generally, the pre-transfer drum charger 100 is provided to prevent so-called retransfer phenomenon wherein a toner to be transferred on a paper is returned to a photoconductive drum.

With the increase in diameter of the photoconductive drum, frequency of generating this re-transfer phenomenon is increasing resulting from the increase in speed of electrostatic recording apparatus.

That is, in an electrostatic recording apparatus using a photoconductive drum in large diameter more than 100 mm, it is difficult to separate a paper from the photoconductive drum in a moment after transferring a toner image on the paper.

In particular, when forming an image on the other surface of a paper (the second image forming process) by an automatic duplex unit (ADU) after forming an image on one surface of the paper (the first image forming process), the front end of the paper curls in the first image forming process and this curl direction agrees with the direction of the paper to wind round the photoconductive drum in the second image forming process. It is therefore easy for the paper to wind round the photoconductive drum in the second image forming process and after completion of the transfer process by the transfer charger, the paper receives the separation charge by the separation charger in the state wherein it is kept adsorbed to the photoconductive drum.

As a result, the potential of a paper drops after it is discharged by the separation charger 34*b* and it becomes difficult to adsorb and keep a toner image transferred on the paper, and if the electrostatic power applied to an image on the photoconductive drum is larger than that of the paper, a toner to be transferred to a paper is returned conversely to the photoconductive drum.

Generally, this retransfer phenomenon tends to be generated at the end of a paper that is available in the market and furthermore, the more the curled state of the paper end is large in the direction it is wound round the photoconductive drum, the more easily this retransfer phenomenon is generated.

To prevent such the retransfer phenomenon, the pre-transfer charger 100 is provided to discharge the surface of the photoconductive drum before transferring an image and increase the electric charge applied to the toner adhered on the photoconductive drum. That is, the charge amount of the toner is increased.

After charging the entire image region by such the pre-transfer charger 100, including a toner image which is an image portion to be formed on the photoconductive drum 30 and a non-image portion without a toner adhered corresponding to a size of a paper to which an image is to be transferred, the toner image transferred on the paper was visually evaluated. Here, the quality of the image formed on a paper resulting from the toner void due to the retransfer phenomenon to the photoconductive drum 30, that is, the retransfer levels were evaluated in 6 ranks from 0 to 5 levels. 0 level was the best quality of image without the toner void and 5 level was the worst quality of image with extremely many toner voids. The retransfer levels were evaluated by changing the charging current supplied to the photoconductive drum 30 by the pre-transfer drum charger 100 variously. Further, this pre-transfer drum charging current is a corona discharging current measured using an aluminum made jig (100 mm diameter, 50 mm width). That is, this pre-transfer drum charging current is in proportion to the current flowing into the photoconductive drum 30.

Figure 3:
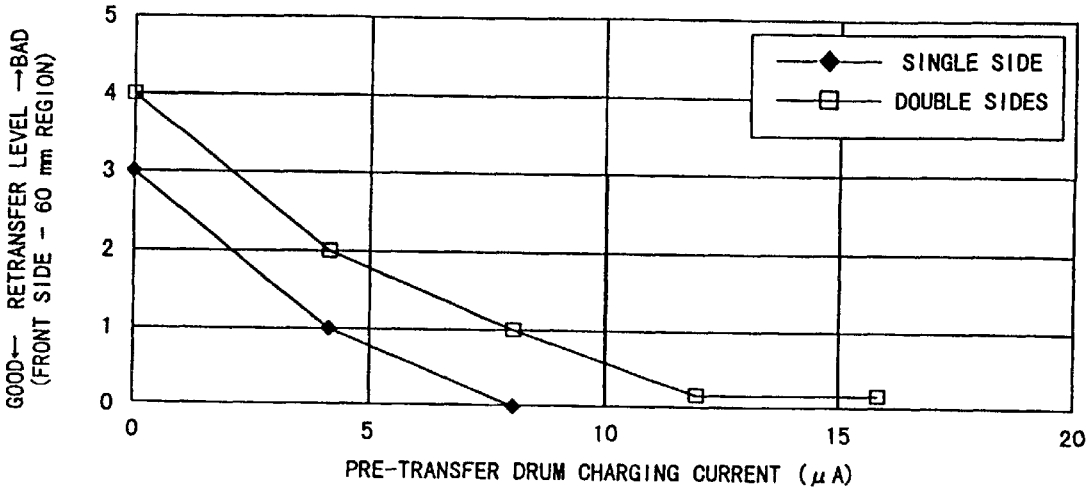
FIG. 3 is a chart showing the evaluated results of the retransfer level in the region from the front end to a 60 mm far away point of the image region on the photoconductive drum of the image forming apparatus shown in FIG. 1.
Figure 4:
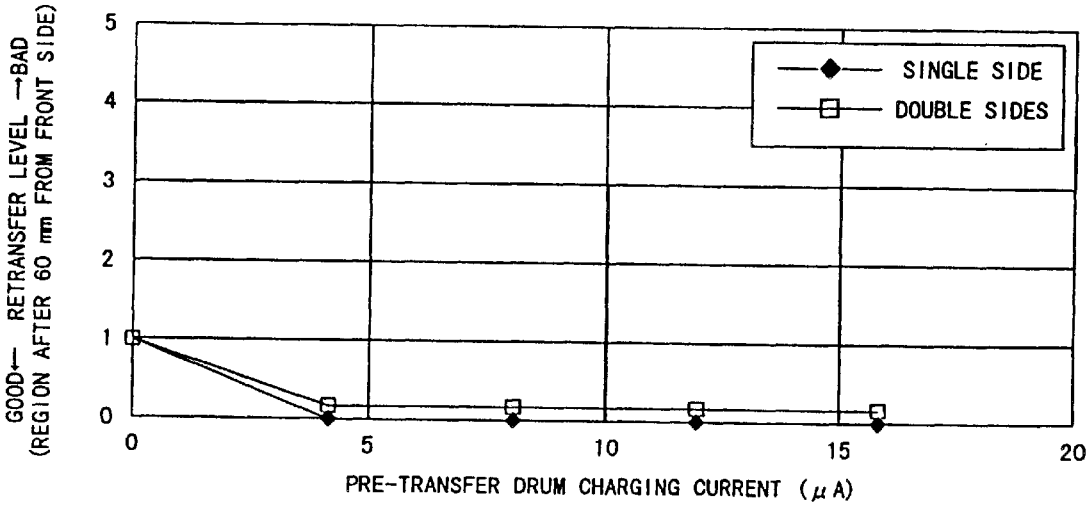
FIG. 4 is a chart showing the evaluated results of the retransfer level in the region after the 60 mm far away point of the image region on the photoconductive drum.

The results are shown in FIGS. 3 and 4.

As shown in FIG. 3, the retransfer in the region from a position corresponding to the leading edge of a transfer paper, that is, the position 60 mm away from the front end of the image region on the photoconductive drum 30 is generated up to the pre-transfer charging current of about 5 $\mu$A. In particular, if an image is formed on the other side of the double sides of a paper after an image was formed on one of the double sides, it can be seen that a remarkable toner void resulting from the retransfer phenomenon was generated at the pre-transfer drum charging current up to about 10 $\mu$A.

On the other hand, as shown in FIG. 4, it can be seen that in the region subsequent to 60 mm from the front end of the image region, a remarkable toner void was not generated when images were formed on both sides of a paper.

In other words, for instance, when a photoconductive drum in diameter up to 100 mm was used, the retransfer phenomenon was apt to be generated in the region up to a point 60 mm far away from the front end of the image region and in particular, when forming images on both sides, the remarkable retransfer phenomenon is generated as a paper is curled so as to wind round the photoconductive drum. However, it was revealed that in the region 60 mm away from the front end of the image region, the retransfer phenomenon was not so frequently generated and that the retransfer phenomenon was not so remarkably generated even when the pre-transfer charging current was 0 $\mu$A, that is, the photoconductive drum was not applied with the pre-transfer electric charge.

Figure 1:
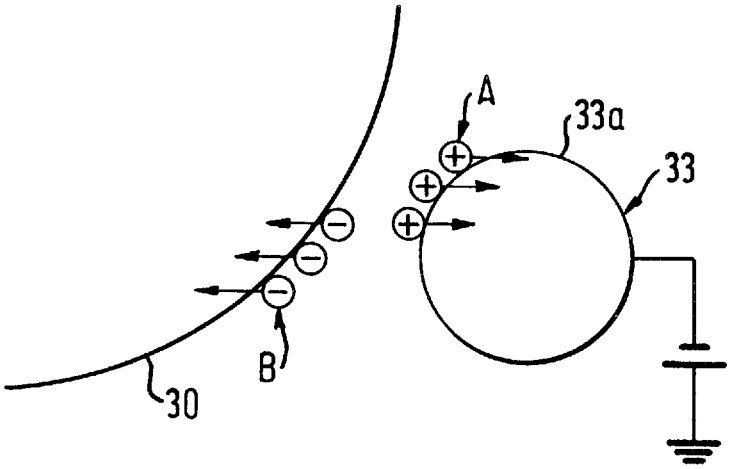
FIG. 1 is a diagram for explaining the relationship of electrostatic force acting on a normal toner and a reverse charged toner which are contained in a developer comprising two-ingredients.

As described above using FIG. 1, toners included in the two-component developer are normal toner A that is positive charged so as to adhere to the image portion on the negative charged photoconductive drum 30 and reverse charged toner B that is negative charged to have the polarity reverse to the normal toner A.

The pre-transfer drum charger 100 enhances the electric charge of the normal toner A by applying positive electric charge to the toner on the photoconductive drum. However, the positive electric charge is given even when the reverse charged toner B is adhered on the photoconductive drum 30 for the reason described above. Therefore, the reverse charged toner B is also transferred to a paper, thus generating fog.

Figure 5:
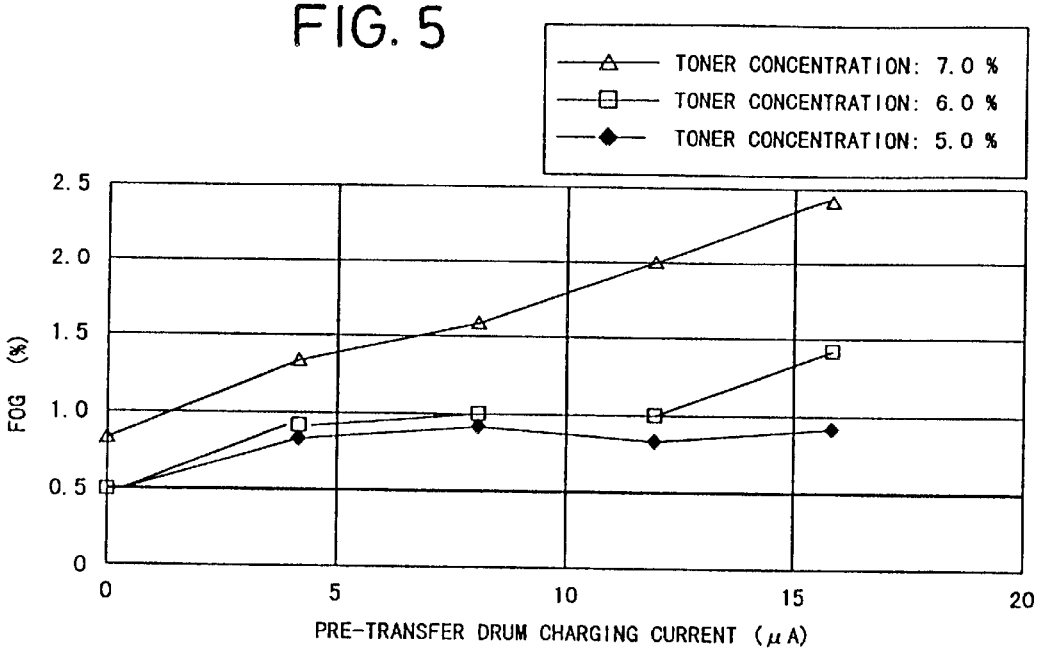
FIG. 5 is a chart showing a fog concentration against the pre-transfer drum charging current for every toner concentration of two-ingredient developer applied to the image forming apparatus shown in FIG. 1.

Such fog generated as an ill effect of the pre-transfer drum charger is generated remarkably as shown in FIG. 5 because the more the toner concentration is high in the two-component developer, the more the quantity of reverse charged toner increases.

That is, as shown in FIG. 5, it was revealed that the fog concentration also increases in proportion to increase in toner concentration when the fog concentration on the white ground was measured at the pre-transfer drum charging current in various toner concentration. Furthermore, it was found that the fog concentration also increased with the increase in the pre-transfer drum charging current.

This is attributable to the fact that with the increase in toner concentration, a ratio of reverse charged toner also increased and in addition, with the increase in the pre-transfer drum charging current, charge of the same polarity as that of normal tone was much added to the reverse charged toner.

The developing device 33 is equipped with a magnetic sensor to control a mixing ratio of toners. However, it is expected that the characteristic of developer changes due to change in the surrounding environment, for instance, change in humidity and the concentration of toner contained in the developer may reach 7%, 1% up from the proper toner concentration, for instance, 6%. At this time, as shown in FIG. 5, depending on size of the pre-transfer drum charging current, the toner concentration increases over the allowable level of fog, that is, the allowable amount of 2% and an image in the deteriorated quality with an extremely high fog concentration is transferred on a paper.

Figure 6:
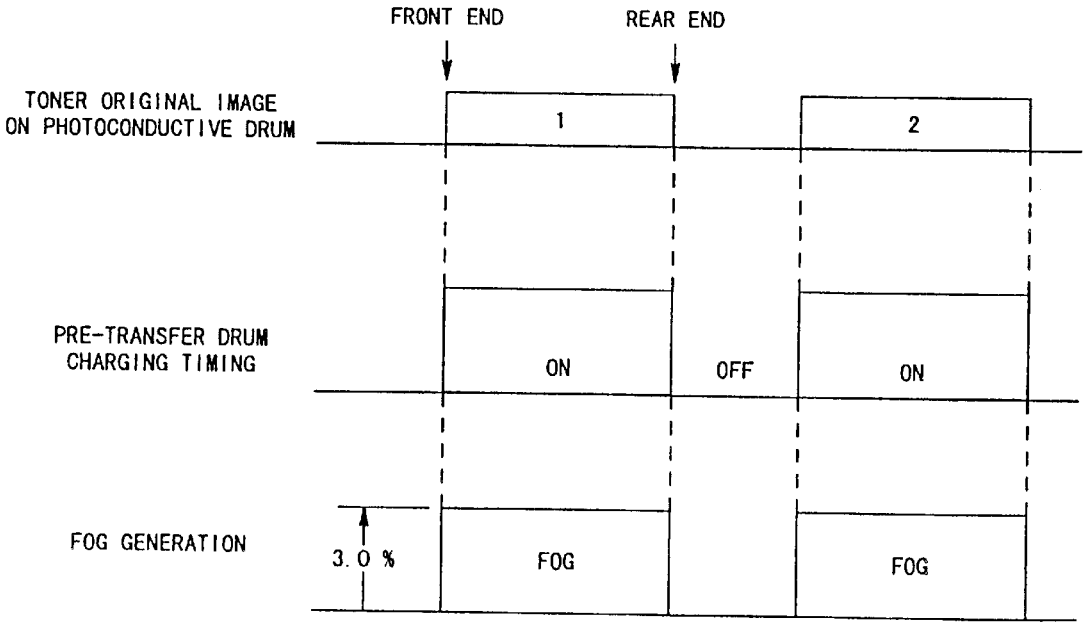
FIG. 6 PRIOR ART
FIG. 6 is a diagram showing the pre-transfer drum charging timing in a conventional pre-transfer drum charger and the fog concentration of an image that is transferred on a paper at that time.

On a conventional pre-transfer drum charger, the entire image region on the photoconductive drum, that is, the entire toner of an original document image corresponding to the region from the leading edge to the trailing edge of a paper was charged as shown in FIG. 6. Therefore, the fog was generated over the entire surface of a paper after the image was transferred and further, the fog concentration was roughly 3%, largely exceeding the allowable amount. As a result, an image in the deteriorated quality was formed over the entire paper.

In view of the above, on the image forming apparatus involved in the embodiment of the present invention, based on the measured results shown in FIGS. 3 and 4, the pre-transfer drum charging is applied only to the image region on the photoconductive drum 30 from its front end to the region 60 mm away therefrom, where the retransfer phenomenon tends to be generated.

Figure 8:
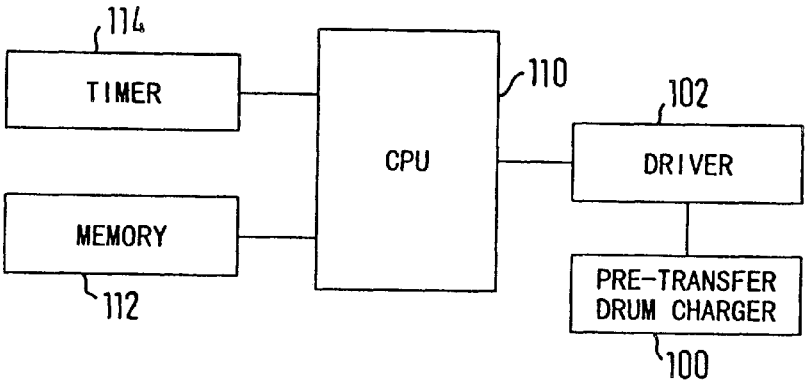
FIG. 8 is a block diagram illustrating a schematic control system of the pre-transfer drum charger equipped to the image forming apparatus shown in FIG. 1.

That is, the image forming apparatus shown in FIG. 2 is equipped with a CPU 110 which functions as a controller shown in FIG. 8. The CPU 110 is connected with a memory 112 and a timer 114. Such data as a time required for a paper to arrive at the front end of the image region on the photoconductive drum 30 after the aligning sensor detected the arrival of the paper, a time required for a paper to advance 60 mm after arriving the front end of the image region, etc. are stored in the memory 112. The timer 114 counts these times.

The CPU 110 is further connected with a driver 102 which drives the pre-transfer drum charger 100 as shown in FIG. 8. This driver 102 includes a transformer which generates driving voltage for driving the pre-transfer drum charger 100 and is capable of turning the driving voltage that is output to the pre-transfer drum charger 100 ON/OFF at a prescribed timing according to the instruction given from the CPU 110.

In order to apply the pre-transfer drum charging only to the image region from its front end to a portion 60 mm away therefrom, the CPU 110 detects the arrival of a paper via the aligning sensor 56*a* and counts a time to operate the timer 114. Further, the CPU 110 reads out the time data stored in the memory 112.

Then, when the aligning sensor 56*a* detects the arrival of paper and a prescribed time corresponding to the read out time data is counted by the timer 114, the CPU 110 controls the driver 102 to drive the pre-transfer drum charger 100. That is, the pre-transfer drum charger 100 is driven at a timing when the front end of the image region of the photoconductive drum 30 comes close to the pre-transfer drum charger 100 and the electric charge of the same polarity as the normal toner is supplied to the photoconductive drum 30 and a toner image from the front end of the image region.

Then, when a prescribed time after driving the pre-transfer drum charger 100, that is, a time required for the front end of the image region to advance 60 mm is counted by the timer 114, the CPU 110 controls the driver 102 to stop to drive the pre-transfer drum charger 100.

Thus, it becomes possible to minimize the fog so far generated over the entire surface of a paper after the transfer of a toner image by the reverse charged toner existing in a developer.

Further, the electric charge is applied only to the image region on the photoconductive drum 30, wherein the retransfer phenomenon tends to be generated and thus, the retransfer phenomenon can be minimized.

Figure 7:
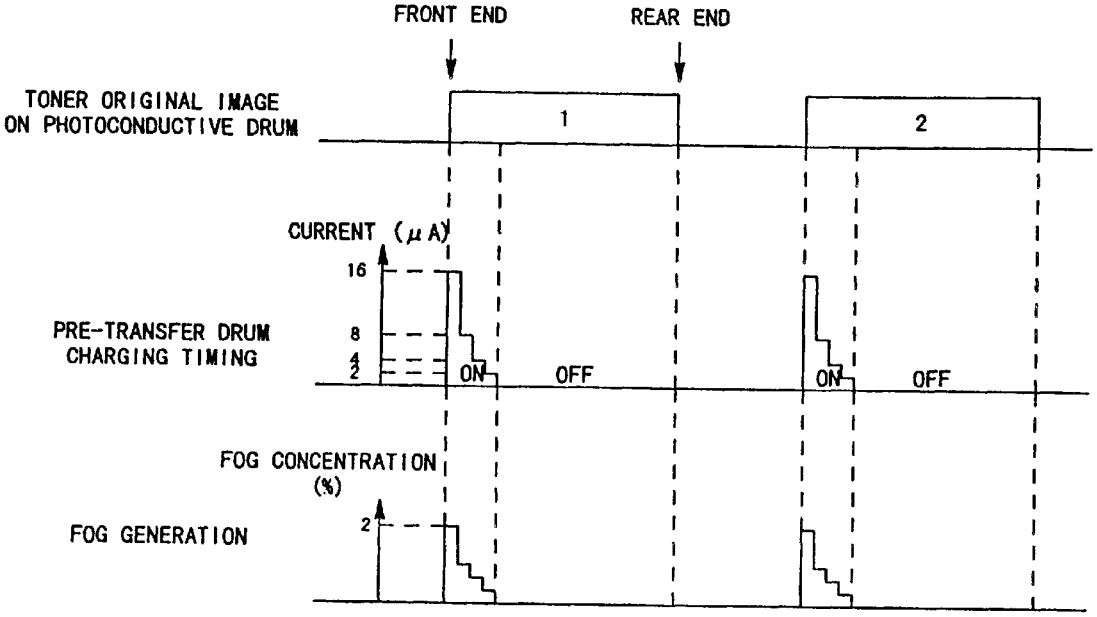
FIG. 7 is a diagram showing the pre-transfer charging timing of a pre-transfer drum charger equipped to the image forming apparatus shown in FIG. 1 and the fog concentration of an image transferred on a paper at that time.

In addition, not necessarily required but this pre-transfer drum charger is able to change the pre-transfer drum charging current by stages in the region from the front end of the image region to a point 60 mm away therefrom as shown in FIG. 7.

Further, the pre-transfer drum charging current is reduced to 0 from the point of time when passed 60 mm from the front end of the image region but it is not necessary to reduce to 0 but micro current of about 2 $\mu$A may be applied.

As shown by the measured results in FIGS. 3 and 4, in the image region from its front end to a point 60 mm away therefrom on the photoconductive drum 30, the retransfer phenomenon most tends to occur for the separation characteristic of paper and therefore, the sufficient pre-transfer drum charging current is needed. Further, as shown in FIG. 5, even in the image region from its front end to a point 60 mm away therefrom, the fog is generated remarkably by the reverse charged toner as the toner concentration contained in a developer becomes higher by 1% than a proper toner concentration (e.g., 6%).

Taking these points into consideration, it is possible to construct the pre-transfer drum charger 100 to be of corona charge type and the driver 102 to include a transformer of which output voltage to the corona wire is variable. And such time data as a time required for the front end of the image region of the photoconductive drum 30 to advance 30 mm, a time required for it to advance 10 mm, etc. and pre-transfer drum charging current data are stored in the memory 112.

For instance, in this embodiment of the present invention, as shown in FIG. 7, the pre-transfer drum charger is controlled so as to supply 16 $\mu$A pre-transfer drum charging current to the region from the front end of the image region to a point 30 mm away therefrom on the photoconductive drum 30, 8 $\mu$A pre-transfer drum charging current to the region from the 30 mm to a point 40 mm away therefrom, 4 $\mu$A pre-transfer drum charging current to the region from 40 mm to a point 50 mm away therefrom and 2 $\mu$A pre-transfer drum charging current to the region from 50 mm to a point 60 mm away therefrom.

In other words, the CPU 110 detects the arrival of paper via the aligning sensor 56*a* and counts a time by operating the timer 114. Further, the CPU 110 reads out time data stored in the memory 112.

Then, the CPU 110 supplies 16 $\mu$A pre-transfer drum charging current to the pre-transfer drum charger 100 at the timing when the front end of the image region of the photoconductive drum 30 is coming close to the pre-transfer drum charger 100 so that the electric charge of the same polarity as that of the normal toner is supplied to the photoconductive drum 30 and a toner image from the front end of the image region.

Further, when a prescribed time after driving the pre-transfer drum charger 100, that is, a required for the front end of the image region to advance 30 mm is counted by the timer 114, the CPU 110 changes over the pre-transfer drum charging current which is supplied to the pre-transfer drum charger 100 to 8 $\mu$A.

Then, when a time required for the front end of the image region to advance further 10 mm is counted by the timer 114, the CPU 110 changes over the pre-transfer drum charging current which is supplied to the pre-transfer drum charger 100 to 4 $\mu$A.

Further, when a time required for the front end of the image region to further advance 10 mm is counted by the timer 114, the CPU 110 changes over the pre-transfer drum charging current which is supplied to the pre-transfer drum charger 100 to 2 $\mu$A.

Then, when a time required for the front end of the image region to further advance 10 mm is counted by the timer 114, the CPU 110 controls the driver 102 to stop to drive the pre-transfer drum charger 100.

Thus, by controlling the output current of the pre-transfer drum charger 100, it becomes possible to make the boundary between the fog existing portion and the fog non-existing portion inconspicuous and further, suppress the fog existing portion to the fog of about maximum 2% within the allowable range.

Thus, it is possible to form a good image without any qualitative problem.

Further, the supply of the electric charge by the pre-transfer drum charger 100 to the region after 60 mm from the front end of the image region is stopped. Therefore, the reverse charged toner adhered to the white ground portion of the image region rebounds on a negative charged transfer paper P and is not transferred on the paper as the electric charge of the same polarity as that of a normal toner is not applied. Accordingly, it is possible to prevent the fog by the reverse charged toner in the region after 60 mm from the front end of the progress direction of a paper.

Further, the current level was changed by stages for the range from the front end of the image region to a point 60 mm away therefrom in this embodiment and even when the current level is controlled so as to drop it successively, the same effect as the above embodiment is obtained.

In addition, in the above embodiment, the development in the normal developing process is described but it is also applicable to the reverse developing process.

Further, in the above embodiment, although the pre-transfer drum charging was executed to both of the front and back of a paper, it may be executed for only the back side of a paper wherein the retransfer is remarkably presented especially and the size of the pre-transfer drum charging may be made larger than the front surface.

Further, in the above embodiment, the current applied to the pre-transfer drum charger is turned ON for the region from the leading edge to the position 60 mm away therefrom of the toner document image region and turned OFF for the region thereafter. However, it is not necessarily required to turn the current OFF but a relatively more weak pre-transfer drum charging current than that for the region from the leading edge to the 60 mm away point may be applied so that an image fog is not generated for the subsequent region. Definitely, when applying the pre-transfer drum charging current for the region from the leading edge to the 60 mm away point, electric charge less than that was applied at around the 60 mm point is applied to the region from the 60 mm away point to the trailing edge of a paper. Even in this case, it is possible to prevent a transfer void and form a satisfactory image while minimizing the generation of an image fog by the reverse charged toner.

As described above, according to the image forming apparatus of the present invention, the pre-transfer drum charging current is applied only to a toner document image region (the front end to a 60 mm point) corresponding to the front end region of a paper wherein the retransfer void tends to occur without applying the pre-transfer drum charging current to the entire toner document image region (the front end to the rear end) on the photoconductive drum. Therefore, it is possible to suppress the retransfer void occurring in the region from the front end to a point 60 mm away therefrom and the fog caused by the reverse charged toner in the region after 60 mm to the minimum.

As described above, according to the present invention it is possible to provide an image forming apparatus which is capable of forming an image of good quality.

What is claimed is:

1. An image forming apparatus comprising:

means for developing an electrostatic latent image formed in a prescribed region on an image carrier corresponding to an original document with a charged developer to form a developer image on the image carrier;

means for transferring the developer image onto an image receiving medium from the image carrier;

means for applying an electric charge having the same polarity as that of the charged developer to the image carrier before transferring the developer image onto the image receiving medium; and means for controlling the applying means so that the electric charge is applied only to a given area extending from a front end of the prescribed region on the image carrier on which the developer image is formed, wherein the given area is smaller than the prescribed region, and wherein an amount of the electric charge is varied in the given area extending from a front end to a rear end of the given area.

2. An image forming apparatus as claimed in claim 1, wherein the controlling means controls the amount of the electric charge applied to the image carrier by the applying means so that the amount of the electric charge is reduced in the given area extending from the front end to the rear end of the given area.

3. An image forming apparatus as claimed in claim 1, wherein the controlling means controls the amount of the electric charge applied to the image carrier by the applying means so that the amount of the electric charge is reduced by stages in the given area extending from the front end to the rear end of the given area.

4. An image forming apparatus as claimed in claim 1, wherein the controlling means controls the amount of the electric charge applied to the image carrier by the applying means so that the amount of the electric charge is successively reduced in the given area extending from the front end to the rear end of the given area.

5. An image forming apparatus comprising:

means for developing an electrostatic latent image formed in a prescribed region on an image carrier corresponding to an original document with a charged developer to form a developer image on the image carrier;

first transfer means for transferring the developer image onto a front surface of an image receiving medium from the image carrier;

means for fixing the transferred developer image on the image receiving medium;

means for inverting the image receiving medium from the front surface to a back surface thereof and feeding the inverted image receiving medium toward the image carrier;

second transfer means for transferring the developer image onto the back surface of the image receiving medium from the image carrier;

means for applying an electric charge having the same polarity as that of the charged developer to the image carrier before transferring the developer image onto the image receiving medium; and means for controlling the applying means so that the electric charge is applied only to a given area extending from a front end of the prescribed region on the image carrier on which the developer image is formed at least when the developer image is transferred onto the back surface of the image receiving medium by the second transfer means, wherein the given area is smaller than the prescribed region, and wherein an amount of the electric charge is varied in the given area extending from a front end to a rear end of the given area.

6. An image forming apparatus as claimed in claim 5, wherein the controlling means controls the amount of the electric charge applied to the image carrier by the applying means so that the amount of the electric charge is reduced in the given area extending from the front end to the rear and of the given area.

7. An image forming apparatus as claimed in claim 5, wherein the controlling means controls the amount of the electric charge applied to the image carrier by the applying means so that the amount of the electric charge is reduced by stages in the given area extending from the front end to the rear end of the given area.

8. An image forming apparatus as claimed in claim 5, wherein the controlling means controls the amount of the electric charge applied to the image carrier by the applying means so that the amount of the electric charge is successively reduced in the given area extending from the front end to the rear end of the given area.

9. An image forming apparatus comprising:

means for charging an image carrier;

means for exposing the charged image carrier to form an electrostatic latent image corresponding to an original document image;

means for developing the electrostatic latent image with a charged developer to form a developer image in a prescribed region on the image carrier;

means for transferring the developer image onto an image receiving medium from the image carrier;

means for applying an electric charge having the same polarity as that of the charged developer to the image carrier before transferring the developer image onto the image receiving medium; and means for controlling the applying means so that a first amount of electric charge is applied to a first area extending from a front end of the prescribed region on the image carrier, and a second amount of electric charge, smaller than the first amount of electric charge, to the image carrier in a second area following the first area, and wherein an amount of the electric charge is varied in the first area extending from a front end to a rear end of the first area.

10. An image forming apparatus as claimed in claim 9, wherein the controlling means controls the amount of the electric charge applied to the image carrier by the applying means so that the amount of the electric charge is reduced in the first area extending from the front end to the rear end of the first area.

11. An image forming apparatus as claimed in claim 9, wherein the controlling means controls the amount of the electric charge applied to the image carrier by the applying means so that the amount of the electric charge is reduced by stages in the first area extending from the front end to the rear end of the first area.

12. An image forming apparatus as claimed in claim 9, wherein the controlling means controls the amount of the electric charge applied to the image carrier by the applying means so that the amount of the electric charge is successively reduced in the first area extending from the front end to the rear end of the first area.

13. An image forming apparatus as claimed in claim 9, wherein the distance from a front end of the first area to a rear end of the second area is equal to a distance from a front end to a rear end of the image receiving medium.

* * * * *